US006643982B1

(12) United States Patent
Lapp, Jr. et al.

(10) Patent No.: US 6,643,982 B1
(45) Date of Patent: Nov. 11, 2003

(54) LIGHT WEIGHT, HOLLOW STRUCTURAL SUPPORT COLUMN

(76) Inventors: John K. Lapp, Jr., 622 N. Shirk Rd., North Holland, PA (US) 17557; Reuben B. Lapp, 205 Linden Grove Rd., North Holland, PA (US) 17557

( * ) Notice: Subject to any disclaimer, the term of this patent is extended or adjusted under 35 U.S.C. 154(b) by 0 days.

(21) Appl. No.: 10/132,338

(22) Filed: Apr. 26, 2002

(51) Int. Cl.[7] ..... E04G 21/26
(52) U.S. Cl. ..... 52/127.2; 52/737.4; 52/736.3
(58) Field of Search ..... 52/126.6, 127.2, 52/260, 737.4, 309.15, 218, 736.3, 219

(56) References Cited

U.S. PATENT DOCUMENTS

| | | | | | |
|---|---|---|---|---|---|
| 1,350,686 | A | * | 8/1920 | Trudelle | 52/736.3 |
| 3,631,789 | A | * | 1/1972 | Kinsey | 454/47 |
| 5,335,471 | A | * | 8/1994 | Kupiec | 52/737.4 |
| 5,471,809 | A | * | 12/1995 | Frankel | 52/737.4 |
| 5,704,188 | A | * | 1/1998 | Coulis | 52/736.3 |
| 6,123,485 | A | * | 9/2000 | Mirmiran et al. | 405/252 |
| 6,219,988 | B1 | * | 4/2001 | Mahfouz et al. | 52/721.4 |
| 6,467,756 | B1 | * | 10/2002 | Elsasser | 256/65.14 |
| 6,484,360 | B1 | * | 11/2002 | DeBartolo et al. | 16/95 R |

OTHER PUBLICATIONS

Publication No.: GB 2 145 212 A Mar. 1985 William John Robert Couchman.*

* cited by examiner

*Primary Examiner*—Carl D. Friedman
*Assistant Examiner*—Nahid Amiri
(74) *Attorney, Agent, or Firm*—William B. Noll

(57) ABSTRACT

An elongated, light weight, maintenance free, hollow structural support post or column for supporting an overhanging roof segment in spaced relationship to a porch floor, for example. The post comprises a thin walled, generally rectangular plastic member containing a circular, metal tubular member therewithin, and spaced from the inner wall of the plastic member by plural elongated, plastic inserts press fit between the metal tubular member and inner wall of the rectangular plastic member. Additionally, the invention includes a pair of uniquely designed end base plates for anchoring the post to the overhanging structure and to the porch floor, where the base plates cooperate with the metal tubular member to prevent twisting of the post when maintained in a compressive or supporting mode.

8 Claims, 3 Drawing Sheets

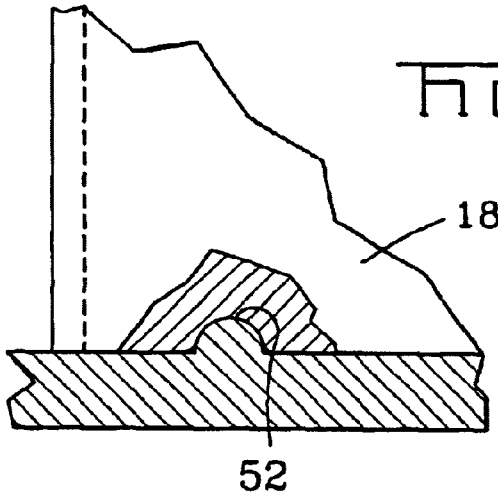
Fig. 4
Fig. 3
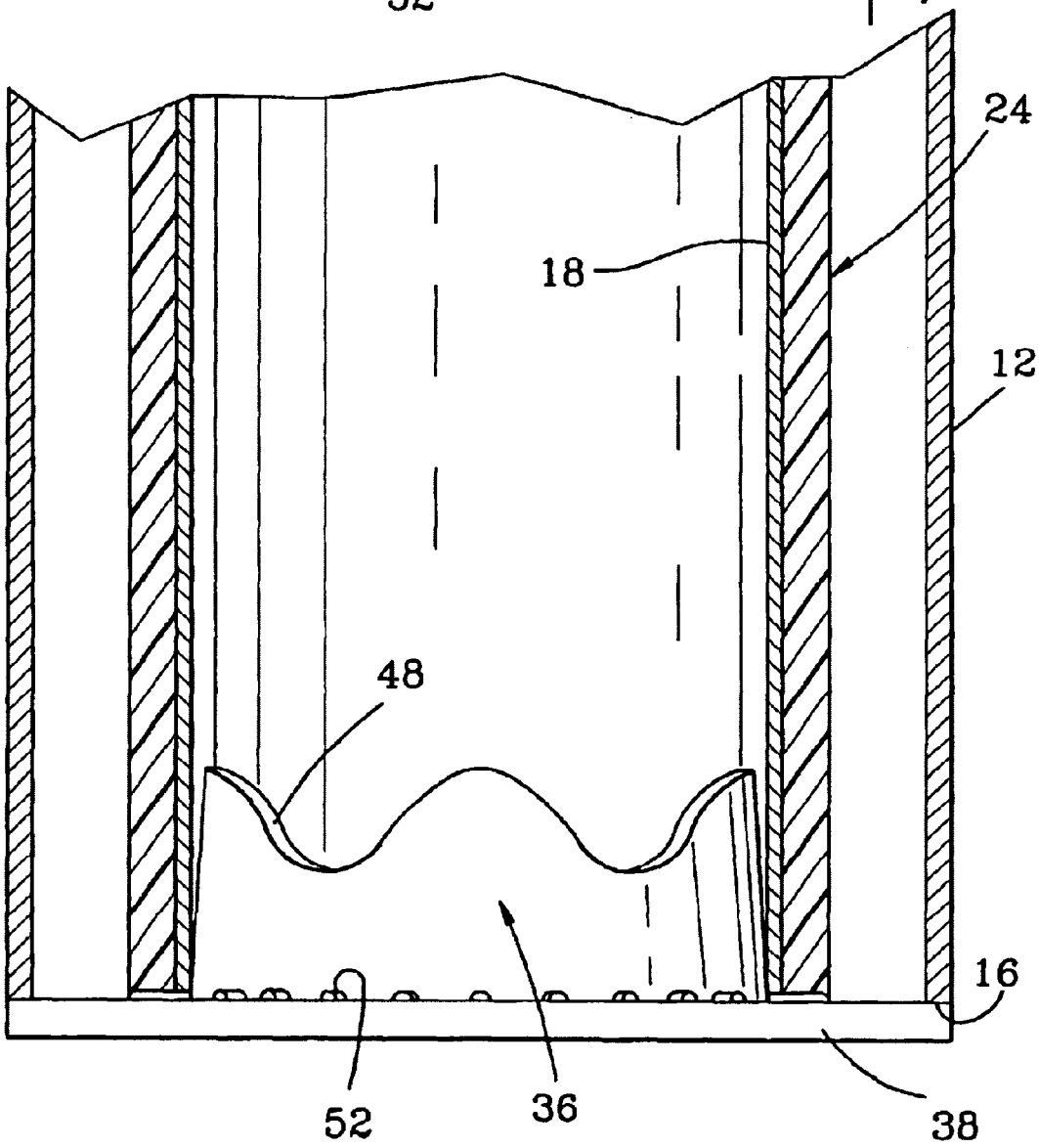

LIGHT WEIGHT, HOLLOW STRUCTURAL SUPPORT COLUMN

FIELD OF THE INVENTION

This invention is directed to the field of structural support columns, such as may be required in supporting an overhanging roof portion for a porch or deck, more particularly to an aesthetically pleasing, hollow PVC column that internally features a metal tubular member and plural, elongated, plastic inserts to provide a high degree of compressive strength in supporting the weight of a structure.

BACKGROUND OF THE INVENTION

The present invention relates to a unique and aesthetically pleasing structural support post to replace conventional wooden posts, such as those commonly referred to as 4×4, or 5×5 inches, that have particular utility as porch or deck support posts, where the porch or deck lies beneath an overhanging roof portion.

Conventional wooden support posts, whether the traditional square or lathe shaped post, are subject to weathering and require labor intensive efforts to maintain its appearance for the life of the post. Additionally, there is always the chance of termite infestation that can cause permanent damage and ultimate replacement of the post. Such wooden support posts have remained the dominant material for residential structural supports, despite the known problems. Little, if anything, has been done to develop a long term, maintenance free support post for a structure, where the post is required to support a weight, such as a roof segment. The present invention is directed to a non-wooden, aesthetically pleasing support post that is maintenance free for the life of the structure.

An interesting innovation for a post support is taught in U.S. Pat. No. 6,349,512, to Berkey, et al., for an adjustable support post. The patent teaches a support post for use in construction mounted to the floor with a base collar which is provided with spacer rings for height adjustment. The spacer rings are inserted into the base collar before the support post is finally positioned in order to provide additional height for the support post as needed in the field.

The present invention teaches a light weight, nonwooden structural support post that is maintenance free, and an effective alternative to conventional support posts that may be used as a structural support for a porch, for example. the manner by which this invention achieves the uniqueness of a support post will become apparent in the description which follows, especially when read in conjunction with the accompanying drawings.

SUMMARY OF THE INVENTION

This invention is directed to a light weight, hollow support post, such as for a porch supporting an overhanging roof segment, that is maintenance free. The support post comprises an elongated, generally rectangular member, such as a 5×5 inch plastic tubular member, where a preferred plastic is PVC, containing a centrally aligned tubular metal member, preferably aluminum, maintained within the plastic tubular member by plural, elongated, U-configured inserts. The respective inserts are press fit between the inner wall of the plastic tubular member and tubular metal member. The base of the insert lies in intimate contact with the tubular metal member, while the respective free ends of the inserts include outwardly extending wings against the inner wall of the plastic tubular member. The wings, in backing support to the inner wall of the plastic tubular member, provide further support in connecting or fastening lateral rail members between a pair of such support posts.

In fixing the support post between a suitable foundation or deck and an overhanging roof segment, a pair of uniquely designed base plates are provided. Each base plate, one secured to each end of the elongated plastic tubular member, comprises a square planar base, dimensioned to the configuration of the plastic tubular member, i.e. 5×5 inches, having plural fastening apertures, one at each corner, and a central upstanding flange with a scalloped upper edge. Further, the flange has a diameter, at its junction with the planar base, sized to slidably engage the tubular metal member, with the upstanding wall angled slightly inwardly to facilitate the engagement with the metal tubular member. Finally, the upper surface of the planar base features plural radial, embossed ribs extending outwardly along the base upper surface from the upstanding flange. When the assembled support post is placed in a compressive mode, i.e. support position between the overhanging roof and supporting foundation, the embossed ribs dig into the metal tubular member and prevent the post from twisting.

Accordingly, a feature of this invention is the provision of a sturdy, light weight support post or column that is both aesthetically pleasing, while having structural strength in a compressive mode to support a structure.

Another feature of the invention lies in the use of a hollow, generally rectangular plastic member that is light weight, maintenance free, and suitable as a support column or post.

A further feature hereof is the provision of a metal tubular member disposed within a hollow plastic casing member, where the metal tubular member is secured therewithin by plural, elongated plastic inserts press fit between the inner wall of the casing member and outer wall of the metal tubular member, whereby to provide a strong and sturdy member in the support of an overhanging structure.

These and other features of the invention will become more apparent from the following specification, particularly when read in conjunction with the accompanying drawings.

BRIEF DESCRIPTION OF DRAWINGS

FIG. 3 is a partial vertical sectional view of the structural post or column of FIG. 1, showing a single base plate assembled thereto.

FIG. 4 is a partial sectional view illustrating how a metal tubular member forming a part of the structural post or column interacts with the base plate to fix the relative position between the post or column and base plate.

DETAILED DESCRIPTION OF PREFERRED EMBODIMENT

Figure 1:
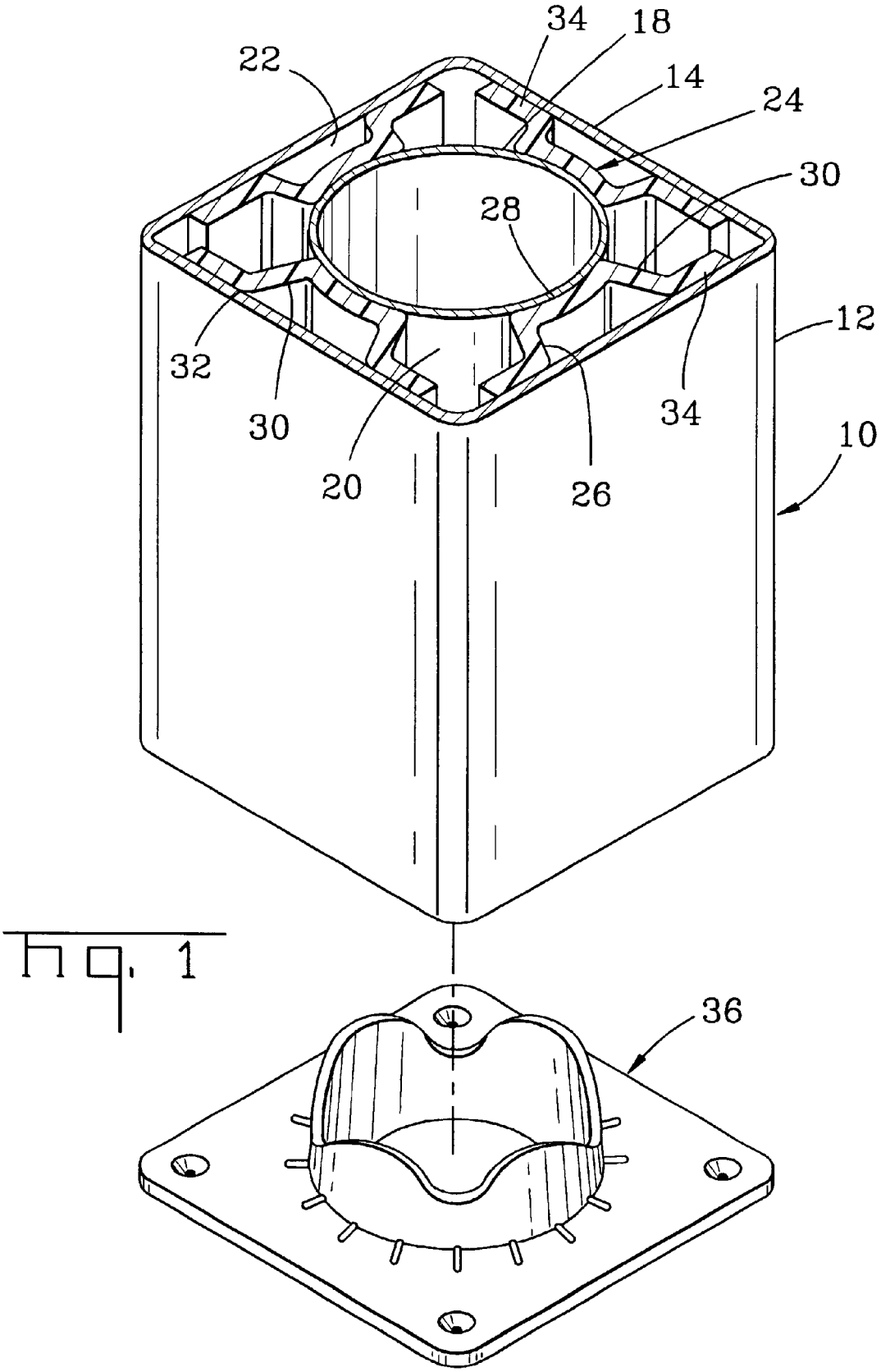
FIG. 1 is an exploded perspective view of an elongated, light weight, hollow structural support or column, further showing a single base plate, according to the present invention.

This invention relates to an elongated, light weight and maintenance free, hollow structural support or column for supporting an overhead structure, such as a roof segment, in spaced relationship to a floor or foundation, where a prime example may be a porch under a portion of a roof. The support post or column, and the unique means for securing same to the roof and foundation, will now be described with regard to the several Figures, where like reference numerals represent like components or features throughout the several views.

Turning now to the several Figures, where FIG. 1 illustrates a section of an exemplary post 10 or column that offers stability and strength for supporting a roof segment, for example, in spaced relationship to a floor, deck or foundation, such as a porch underlying an overhanging roof segment. It will be understood that an exemplary post or column is an elongated member, typically having a length of eight to ten feet, or even more as the post may be readily cut to a desired length. In any case, the post 10, where details thereof are further illustrated in FIGS. 1 and 2, comprises an elongated, generally rectangular body 12, such as a 4×4 inches or 5×5 inches, fabricated of plastic, where a preferred material is a polyvinyl chloride (PVC), as known in the art. The body features a pair of open ends 14, 16, (see also FIG. 3) and a relatively thin wall, preferably on the order of about 0.145 inches.

Internally, the body 12, as best seen in FIG. 1, includes a centrally disposed metal tubular member 18, such as aluminum, having a predetermined I.D., such as about three inches for a 5×5 inch body 12, with a preferred wall thickness of about 0.75 inches. Disposed about said metal tubular member 18, in intimate contact with the outside wall 20 of the metal tubular member 18 and the inner wall 22 of the body 12, are plural plastic inserts 24, preferably four in number, and fabricated of plastic, where a preferable material is a high density polyethylene.

The inserts 24, press fit between the metal tubular member 18 and inner wall of the body 12 to form a sturdy integral unit, comprises a generally U-configured body 26 having a curved base portion 28 to lie against and conform to the curved wall of the metal tubular member 18, and a pair of upwardly and outwardly extending arms 30. The free end 32 of each arm 30 further includes a lateral wing 34 in intimate contact with the inner wall 22. The respective wings 34 serve an additional function. It is not unusual to desire and even require a lateral rail structure between adjacent posts 10. In such a situation, the supporting wings 34 provide a backing to the otherwise thin wall of body 12 to receive fastening elements as a way to safely and effectively secure such rail structure to the post 10.

Figure 2:
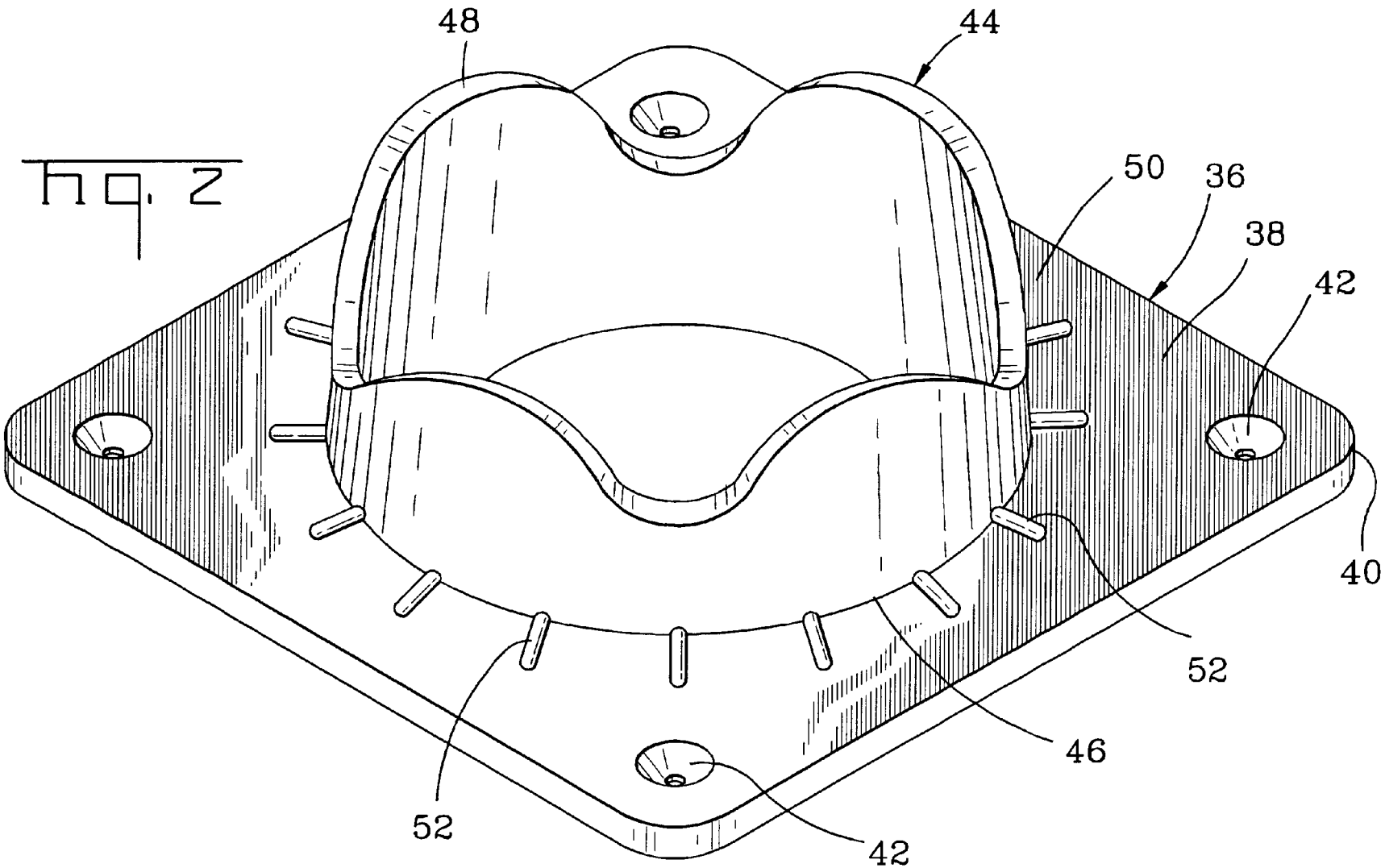
FIG. 2 is a perspective view of the single base plate shown in FIG. 1, and forming part of the assembly of this invention.

To securely mount the post 10 between the overhanging structure and foundation, a pair of uniquely designed end plates 36, one each for the top and bottom of the post, are provided, see FIGS. 1 and 2. As best seen in FIG. 2, the end plate 36 comprises a planar base 38, generally rectangular in shape, comparable to that of the body 12, i.e. 4×4 or 5×5 inches, for example. At the respective corners 40, the planar base includes plural through apertures 42 for receiving fastening elements, as known in the art, to secure the base plates as noted above. Centrally upstanding from the planar base is an inwardly tapered, by several degrees, circular flange 44, where the diameter of the flange base 46 is essentially equal to the I.D. of the metal tubular member 18, see FIG. 3. The circular flange 44 features a scalloped upper edge 48 as best seen in FIG. 2. Further, as seen in FIGS. 1 and 2, the upper surface 50 of planar base 38 features a plurality of radially extending embossed ribs 52 extending from the flange base 46. The purpose of such ribs 52, particularly its function with regard to the metal tubular member 18, will be described hereafter.

In the assembly or positioning of the support post 10 or column in supporting relationship between a roof segment and foundation, the roof segment is temporarily braced about ¼ inches greater than the final length of the post 10. The post and end plates are positioned at the desired location where the post 10 is easily pivoted or twisted relative to the end plates. Specifically, the post is twisted about 45° about the circular flange to expose the apertures 42 to allow securing of the end plates, which are vertically aligned, to the roof segment and foundation by fastening elements known to the art. Thereafter, the post body 12 is twisted and returned to a position flush with the planar base to thus hide the apertures and fastening elements. The temporary braces may then be removed bringing the roof segment into a compressive relationship to the post body 12. This action forces the metal tubular member 18 into an intimate and slightly deformed contact with the ribs 52, see FIG. 4, thereby fixing the post body to the end plate 36 against relative rotative movement therebetween. In a preferred embodiment, the end plate is made of steel, while the metal tubular member 18 is fabricated from aluminum, a softer and more easily deformable metal when compressed against the ribs 52. In any case, the resulting assembly presents a sleek and smooth post or column that is maintenance free, particularly when exposed to external environmental conditions.

It is recognized that variations, changes and modifications may be made to the structural post and end plate assembly of this invention, especially by those skilled in the art, without departing from the spirit and scope thereof Accordingly, no limitation is intended to be imposed thereon except as set forth in the accompanying claims.

What is claimed is:

1. A light weight, hollow structural support column, said support column comprising:

a.) an elongated, hollow, generally rectangular plastic member having an inner wall;

b.) a circular metallic tubular member extending the length of said rectangular member and centrally disposed therewithin, and having an outer wall;

c.) a plurality of elongated U-configured plastic inserts extending between said inner wall and said outer wall; and, d.) a base plate for each end of said rectangular member, said base plate comprising a planar base of a size coextensive with said rectangular member and having an upstanding, circular annular flange, where the outside diameter of said annular flange is of a size to be slidably and rotatively received within said circular tubular member.

2. The light weight, hollow structural support column according to claim 1, wherein said plastic member comprises a thin walled body and fabricated of polyvinyl chloride (PVC).

3. The light weight, hollow structural support column according to claim 1, wherein said circular annular flange is angled inwardly to facilitate the sliding engagement of said circular annular flange into said circular tubular member.

4. The light weight, hollow structural support column according to claim 1, wherein said circular annular flange includes an upper surface, said surface defined by a scalloped profile.

5. The light weight, hollow structural support column according to claim 4, wherein said planar base includes a first surface from which said circular annular flange extends, and said first surface includes a series of radially extending ribs projecting outwardly from said circular annular flange.

6. The light weight, hollow structural support column according to claim 5, wherein said metallic tubular member is fabricated of aluminum, and said base plate is fabricated of steel.

7. The light weight, hollow structural support column according to claim 6, wherein in an operable supporting mode said aluminum tubular member is deformed in compressive contact with said radially extending ribs to fix the relative position of said tubular member to said rectangular plastic member.

8. A light weight, hollow structural support column, said support column comprising:

a.) an elongated, hollow, generally rectangular plastic member having an inner wall;

b.) a circular metallic tubular member extending the length of said rectangular member and centrally disposed therewithin, and having an outer wall; and, c.) a plurality of elongated U-configured plastic inserts extending between said inner wall and said outer wall, said plastic inserts having a base in intimate contact with said outer wall, and a pair of free arms, each said arm terminating in a laterally extending wing member with said wing members in intimate contact with said inner wall.

* * * * *